US010989226B2

(12) United States Patent
Tracy

(10) Patent No.: US 10,989,226 B2
(45) **Date of Patent: *Apr. 27, 2021**

(54) FAN OPTIMIZING ACOUSTIC CHARACTERISTICS

(71) Applicant: Dennis A Tracy, Culver City, CA (US)

(72) Inventor: Dennis A Tracy, Culver City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/397,451

(22) Filed: Apr. 29, 2019

(65) Prior Publication Data

US 2019/0249688 A1 Aug. 15, 2019

Related U.S. Application Data

(63) Continuation of application No. 15/141,200, filed on Apr. 28, 2016, now Pat. No. 10,280,943.

(60) Provisional application No. 62/155,022, filed on Apr. 30, 2015.

(51) Int. Cl.

| | |
|---|---|
| ***F04D 29/66*** | (2006.01) |
| ***F04D 25/08*** | (2006.01) |
| ***F04D 29/38*** | (2006.01) |
| ***F04D 29/32*** | (2006.01) |
| *F24F 13/24* | (2006.01) |

(52) U.S. Cl.

CPC ..... *F04D 29/664* (2013.01); *F04D 25/088* (2013.01); *F04D 29/325* (2013.01); *F04D 29/384* (2013.01); *F24F 13/24* (2013.01)

(58) Field of Classification Search

CPC ..... F04D 25/088; F04D 25/08; F04D 29/66; F04D 29/661; F04D 29/663; F04D 29/664; F04D 29/665; F04D 29/325; F04D 29/384; F04D 29/005; F04D 29/023; F24F 13/24; F24F 2013/242; F05D 2260/96; E04B 1/8209; E04B 1/84; E04B 1/99; E04B 2001/8263; E04B 9/00; E04B 9/006

USPC ..... 416/210 R; D23/385

See application file for complete search history.

(56) References Cited

U.S. PATENT DOCUMENTS

| | | | | |
|---|---|---|---|---|
| 2,715,449 | A * | 8/1955 | Lemmerman et al. | F21V 33/00 181/30 |
| 4,884,947 | A * | 12/1989 | Rezek | F04D 25/088 416/5 |
| D312,688 | S * | 12/1990 | Mason | D23/377 |
| 7,694,779 | B2 * | 4/2010 | Takayasu | G10K 11/162 181/286 |
| 10,280,943 | B2 * | 5/2019 | Tracy | F04D 29/384 |
| 2014/0255150 | A1 * | 9/2014 | Di Falco | F04D 25/088 415/1 |

* cited by examiner

*Primary Examiner* — Richard A Edgar
(74) *Attorney, Agent, or Firm* — Welsh Flaxman & Gitler LLC

(57) ABSTRACT

A fan optimizing acoustic characteristics includes a yoke adapted to secure the fan to a building member and a central support structure extending from the yoke. The central support structure is an elongated member having a first end and a second end, the first end being selectively secured to the yoke and the second end extending downwardly therefrom. A fan assembly is secured to the second end of the central support structure. The fan also includes a plurality of sound absorbing elements.

11 Claims, 2 Drawing Sheets

FAN OPTIMIZING ACOUSTIC CHARACTERISTICS

CROSS REFERENCE TO RELATED APPLICATION

This application is a continuation of U.S. patent application Ser. No. 15/141,200, entitled "FAN OPTIMIZING ACOUSTIC CHARACTERISTICS," filed Apr. 28, 2016, which claims the benefit of U.S. Provisional Patent Application Ser. No. 62/155,022, entitled "FAN OPTIMIZING ACOUSTIC CHARACTERISTICS," filed Apr. 30, 2015.

BACKGROUND OF THE INVENTION

1. Field of the Invention

The present invention relates to a fan optimizing acoustic characteristics associated with use thereof.

2. Description of the Related Art

As anyone who has eaten at a popular restaurant can appreciate, ambient noise can make it difficult to hear what your dinner companion is saying only a few feet away. From the conversations of the people sitting at a neighboring table, to the sounds coming from the kitchen and the restaurant lobby, the sound generated in a small space can often rise to an unacceptably high level and ultimately ruin an otherwise good evening out.

There exists, therefore, a need to control the noise pollution. The present invention provides such a mechanism in the form of a fan offering optimized acoustics characteristics. The present fan achieves this by combining surfaces designed to capture and/or minimize ambient noise with noise absorbing materials.

SUMMARY OF THE INVENTION

It is, therefore, an object of the present invention to provide a fan optimizing acoustic characteristics. The fan includes a yoke adapted to secure the fan to a building member and a central support structure extending from the yoke. The central support structure is an elongated member having a first end and a second end, the first end being selectively secured to the yoke and the second end extending downwardly therefrom. A fan assembly is secured to the second end of the central support structure. The fan also includes a plurality of sound absorbing elements.

It is also an object of the present invention to provide a fan wherein the central support structure is hollow and provides a passageway for electrical wires bringing power to the fan assembly.

It is another object of the present invention to provide a fan wherein the plurality of sound absorbing elements includes a ceiling cover member shaped and dimensioned for installation adjacent a ceiling of the building member in a position opposite the yoke.

It is a further object of the present invention to provide a fan wherein the ceiling cover member is covered with a sound absorbing material.

It is also an object of the present invention to provide a fan wherein the ceiling cover member is semi-spherical with a convex exterior surface and a concave interior surface.

It is another object of the present invention to provide a fan wherein the plurality of sound absorbing elements includes a parabolic sound absorbing assembly positioned beneath the ceiling cover member and between the ceiling cover member and the fan assembly.

It is a further object of the present invention to provide a fan wherein the fan assembly includes fan blades and each of the fan blades is coated with a sound absorbing material.

It is also an object of the present invention to provide a fan wherein the parabolic sound absorbing assembly includes an upper parabolic sound absorbing member and a lower parabolic sound absorbing member.

It is another object of the present invention to provide a fan wherein the upper parabolic sound absorbing member and the lower parabolic sound absorbing member are covered with the sound absorbing material.

It is a further object of the present invention to provide a fan wherein the upper parabolic sound absorbing member and the lower parabolic sound absorbing member are of a circular construction.

It is also an object of the present invention to provide a fan wherein each of the upper parabolic sound absorbing member and the lower parabolic sound absorbing member include a circumferential edge defining a circumference of the respective upper parabolic sound absorbing member and the lower parabolic sound absorbing member, and the diameter of the upper parabolic sound absorbing member is greater than the diameter of the lower parabolic sound absorbing member and the circumferential edge of the upper parabolic sound absorbing member extends beyond the circumferential edge of the lower parabolic sound absorbing member.

It is another object of the present invention to provide a fan wherein the upper parabolic sound absorbing member is semi-spherical with a convex exterior surface and a concave interior surface, and the lower parabolic sound absorbing member is semi-spherical with a convex exterior surface and a concave interior surface.

It is a further object of the present invention to provide a fan wherein the concave interior surface of the lower parabolic sound absorbing member faces upwardly toward the concave interior surface of the upper parabolic sound absorbing member.

It is also an object of the present invention to provide a fan wherein the circumferential edge of the upper parabolic sound absorbing member extends beyond the circumferential edge of the lower parabolic sound absorbing member.

It is another object of the present invention to provide a fan wherein the fan assembly includes an electric powered motor and a blade frame having fan blades extending therefrom.

It is a further object of the present invention to provide a fan wherein each of the fan blades includes curved surfaces defining a radius of curvature.

It is also an object of the present invention to provide a fan wherein each of the fan blades includes a convex, upwardly facing surface and a concave, downwardly facing surface.

It is another object of the present invention to provide a fan wherein the convex, upwardly facing surface is coated with a sound absorbing material and the concave, downwardly facing surface is coated with a sound absorbing material.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

Figure 1:
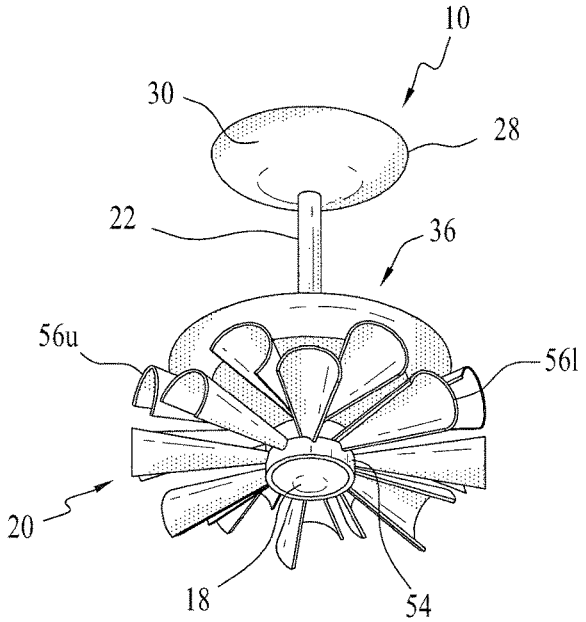
FIG. 1 is a perspective view from beneath the fan (as shown unmounted).
Figure 2:
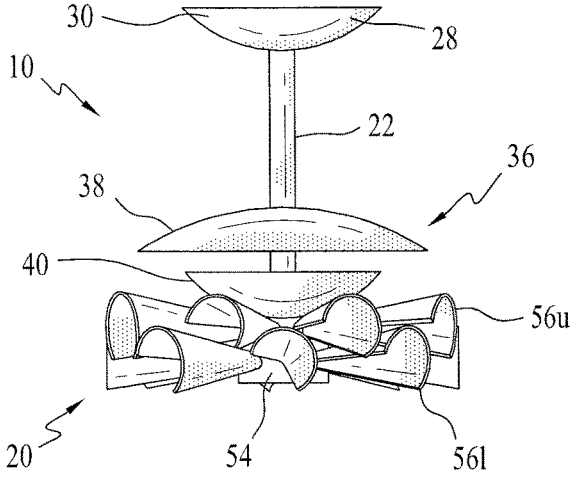
FIG. 2 is a side view of the fan shown in FIG. 1.
Figure 3:
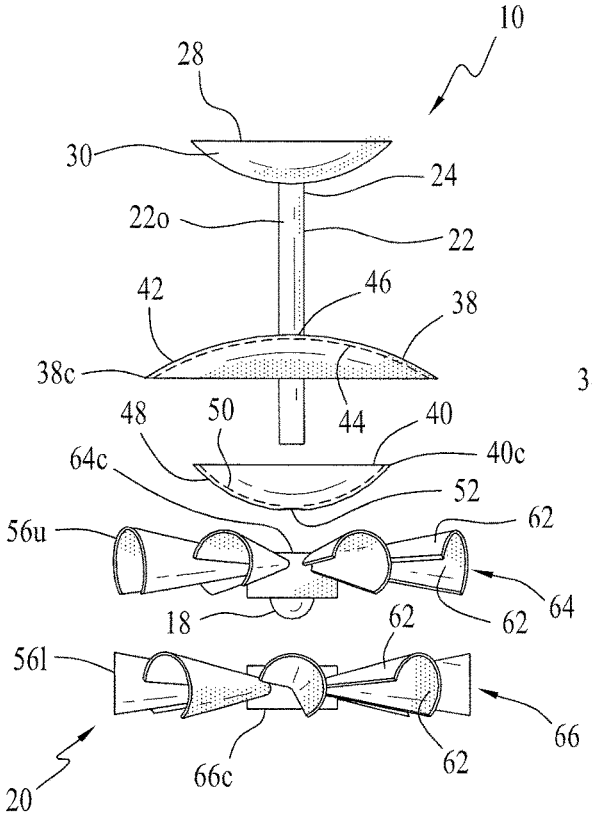
FIG. 3 is an exploded side view of the fan shown in FIG. 1.
Figure 4:
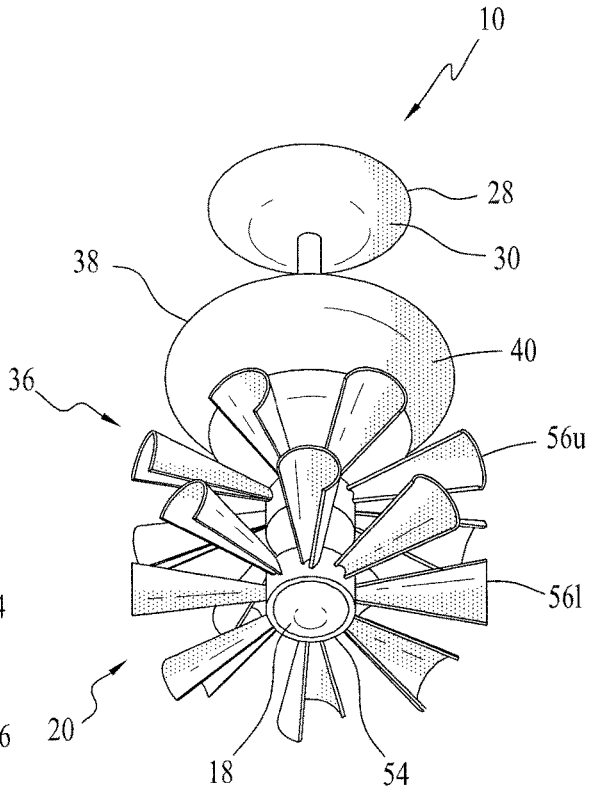
FIG. 4 is another perspective view from beneath the fan shown in FIG. 1.
Figure 5:
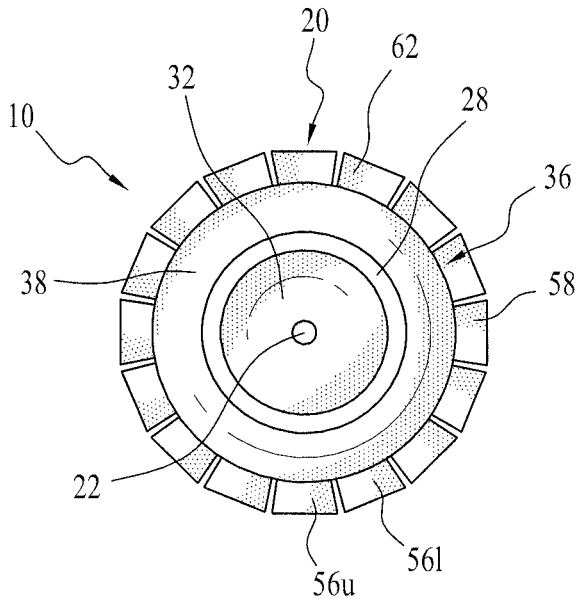
FIG. 5 is a top plan view of the fan shown in FIG. 1.
Figure 6:
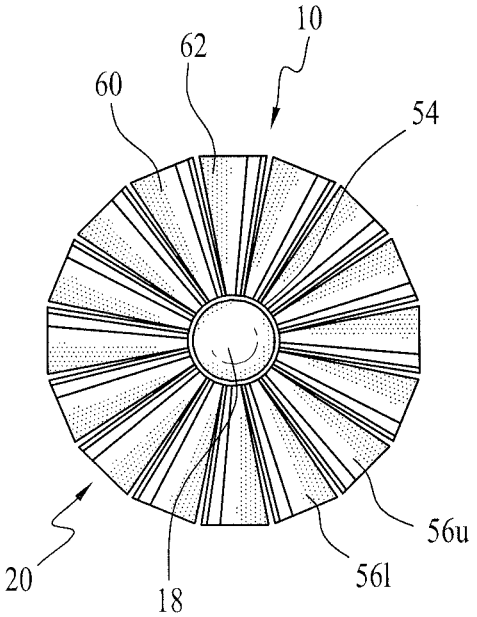
FIG. 6 is a bottom plan view of the fan shown in FIG. 1.
Figure 7:
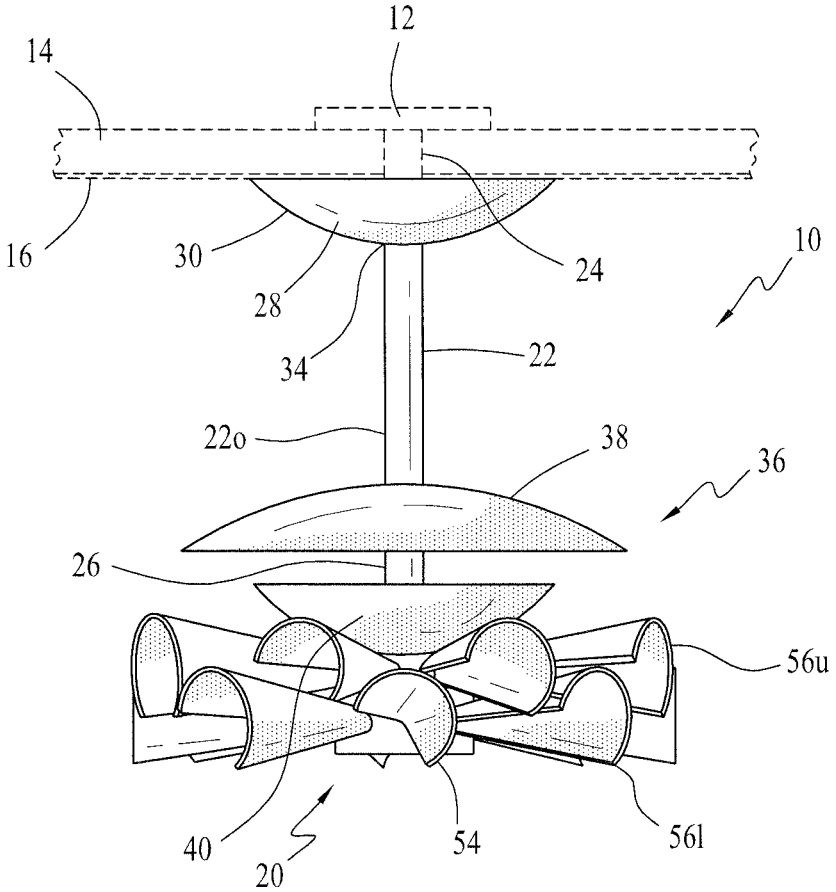
FIG. 7 is a detailed side view of the fan (shown in FIG. 1) mounted to a ceiling.

With reference to FIGS. 1 to 7, a fan 10 in accordance with the present invention is disclosed. The fan 10 is constructed to optimize the acoustic characteristics thereof for the purpose of providing quite operation and reducing undesirable ambient sound. While the fan 10 is described below as constructed in the manner of a ceiling fan, it is appreciate the concepts underlying the present invention may be applied to a variety of fan constructions without departing from the spirit of the present invention.

The present fan 10 is constructed for use as a ceiling fan and includes a yoke 12 securing the fan 10 to a building member 14 in a manner well known to those skilled in the art. The yoke 12 is mounted above ceiling 16 and is commonly hidden from view when the fan 10 is mounted and put into use. The yoke 12 provides structure for connecting the fan 10 to a power source and for extending wiring from the yoke 12 to the motor 18 of the fan assembly 20.

Extending from the yoke 12 is a central support structure 22. The central support structure 22 is an elongated member having a first end 24 and second end 26. The first end 24 is selectively secured to the yoke 12 and the second end 26 extends downwardly therefrom such that it extends downwardly from the ceiling 16. The fan assembly 20 is secured to the second end 26 of the central support structure 22. As with conventional fans, the central support structure 22 is hollow and provides a passageway for electrical wires bringing power to the motor 18 of the fan assembly 20.

Between the fan assembly 20 and the yoke 12, and on the side of the ceiling 16 opposite the yoke 12 are provided a plurality of sound absorbing elements. These sound absorbing elements include a ceiling cover member 28. The ceiling cover member 28 is shaped and dimensioned for installation adjacent the ceiling 16 in a position opposite the yoke 12. As such, the yoke 12 and the ceiling cover member 28 form a sandwich with the ceiling 16 therebetween.

The ceiling cover member 28 is semi-spherical with a convex exterior surface 30 and a concave interior surface 32. As used herein the term "semi-spherical" is intended to refer to an object that is somewhat spherical in shape. The ceiling cover member 28 also includes a central aperture 34 shaped and dimensioned for the passage of the central support structure 22 therethrough.

Positioned beneath the ceiling cover member 28 and between the ceiling cover member 28 and the fan assembly 20, is parabolic sound absorbing assembly 36. The parabolic sound absorbing assembly 36 includes an upper parabolic sound absorbing member 38 and a lower parabolic sound absorbing member 40. Considering their orientation on the fan 10, the upper parabolic sound absorbing member 38 is positioned between the ceiling cover member 28 and the lower parabolic sound absorbing member 40, while the lower parabolic sound absorbing member 40 is positioned between the fan assembly 20 and the upper parabolic sound absorbing member 38.

As will be explained below in greater detail, the upper parabolic sound absorbing member 38 and the lower parabolic sound absorbing member 40 are of a circular construction. Each of the upper parabolic sound absorbing member 38 and the lower parabolic sound absorbing member 40 include a circumferential edge 38*c*, 40*c* defining a circumference of the respective upper parabolic sound absorbing member 38 and the lower parabolic sound absorbing member 40. The diameter of the upper parabolic sound absorbing member 38 is greater than the diameter of the lower parabolic sound absorbing member 40. As such, the circumferential edge 38*c* of the upper parabolic sound absorbing member 38 extends beyond the circumferential edge 40*c* of the lower parabolic sound absorbing member 40.

The upper parabolic sound absorbing member 38 is semi-spherical with a convex exterior surface 42 and a concave interior surface 44. The convex exterior surface 42 faces upwardly, that is, toward the ceiling cover member 28. As with the ceiling cover member 28, the upper parabolic sound absorbing member 38 includes a central aperture 46 shaped and dimensioned for the passage of the central support structure 22 therethrough.

The lower parabolic sound absorbing member 40 is semi-spherical with a convex exterior surface 48 and a concave interior surface 50. The convex exterior surface 48 faces downwardly, that is, toward the fan assembly 20. As such, the concave interior surface 50 of the lower parabolic sound absorbing member 40 faces upwardly toward the downwardly facing concave interior surface 44 of the upper parabolic sound absorbing member 38. As with the ceiling cover member 28 and the upper parabolic sound absorbing member 38, the lower parabolic sound absorbing member 40 includes a central aperture 52 shaped and dimensioned for the passage of the central support structure 22 therethrough.

With the concave interior surface 44 of the upper parabolic sound absorbing member 38 facing the concave interior surface 50 of the lower parabolic sound absorbing member 40, the circumferential edge 38*c* of the upper parabolic sound absorbing member 38 extends beyond the circumferential edge 40*c* of the lower parabolic sound absorbing member 40. The provides a gap into which sound may pass and be drawn into the space defined by the concave interior surface 44 of the upper parabolic sound absorbing member 38 and the concave interior surface 50 of the lower parabolic sound absorbing member 40.

As for the fan assembly 20, it is secured to the second end 26 of the central support structure 22 such that the parabolic sound absorbing assembly 36 is between the ceiling cover member 28 and the fan assembly 20. The fan assembly 20 employs an electric powered motor 18 generally composed of a motor axle, a stator, and a rotor to rotate a blade frame 54 of the fan assembly 20. As those skilled in the art will appreciated, various motor assembly may be used without departing from the invention and the present disclosure merely presents one of a variety of motor assemblies that may be used in accordance with the present invention.

By way of example, and as those skilled in the art will appreciate, the stator is fixed on the motor axle. The stator is surrounded with a plurality of magnetizing coils. The stator preferably has a predetermined number of equally spaced coil arms in the perpendicular direction toward the motor axle. The rotor is rotationally mounted on the motor axle through a bearing. In this embodiment, the rotor has several magnetic objects positioned around the stator. The magnetic objects can be permanent magnets. In practice, each of the magnetizing coils is driven by the input voltage to produce an induced magnetic field. The rotor is thus driven to rotate with respect to the stator and build up inertia. The rotor is connected to, and surrounded by, a blade frame 54 in a manner providing for the selective rotation of the blade frame 54 upon the actuation of the motor 18 in a manner known to those skilled in the art. The blade frame 54 includes several fan blades 56*u*, 56*l* extending outwardly therefrom.

Each of the fan blades 56*u*, 56*l* includes curved surfaces defining a radius of curvature. More specifically, each of the fan blades 56*u*, 56*l* includes a convex, upwardly facing surface 58 and a concave, downwardly facing surface 60. The upwardly facing surface 58 is directed toward the parabolic sound absorbing assembly 36 and the ceiling cover member 28, while the downwardly facing surface 60 is directed away from the parabolic sound absorbing assembly 36 and the ceiling cover member 28 such that it faces, for example, the floor beneath a ceiling 16 upon which the present fan 10 has been mounted. While the specific radius of curvature is not critical it is important that the radius of curvature be appropriate to assist in the reduction of ambient sound. With this in mind, the fan blades 56*u*, 56*l* are shaped to effectively "trap" sound within the curvature so that the sound, preferably the mid and high frequency sound waves, may be absorbed by a sound absorbing material 62 with which the fan blades 56*u*, 56*l* are coated or covered so as to form the exterior surface thereof. The curvature effectively reflects the sound waves coming into contact with the concave downwardly facing surface 60 of each blade 56*u*, 56*l* so that the sound waves are directed to other surfaces of the downwardly facing surface 60 of each blade 56*u*, 56*l* where the sound waves are ultimately absorbed by the sound absorbing material 62 with which the fan blades 56*u*, 56*l* are coated or covered.

As briefly discussed above, the fan blades 56*u*, 56*l* are coated or covered with a sound absorbing material 62 so as to form the exterior surface thereof. The downwardly facing surface 60 of each fan blade 56*u*, 56*l* is coated with a sound absorbing material 62 and the upwardly facing surface 58 of each fan blade 56*u*, 56*l* is coated with a sound absorbing material 62. In accordance with a preferred embodiment, the sound absorbing material 62 is ACOUSTIMAX™, a sound absorbing nonwoven fabric material manufactured by Owens Corning Inc. The sound absorbing material 62 absorbs sound to optimize the acoustic characteristics of the fan 10.

In addition to the fan blades 56*u*, 56*l* being coated or covered with a sound absorbing material, other components of the fan 10 are also coated or covered with the same sound absorbing material 62. For example, the outer surface 22*o* of the central support structure 22, the convex exterior surface 30 of the ceiling cover member 28, the convex exterior surface 42 and the concave interior surface 44 and the upper parabolic sound absorbing member 38, the convex exterior surface 48 and the concave interior surface 50 of the lower parabolic sound absorbing member 40, and the exposed surfaces of the fan assembly 20 are all covered or coated with the sound absorbing material 62.

In accordance with a preferred embodiment, the blade frame 54 includes an upper blade frame assembly 64 and a lower blade frame assembly 66. The upper blade frame assembly 64 and the lower blade frame assembly 66 are fixed relative to each other and rotate together under the control of the motor 18. Each of the upper blade frame assembly 64 and lower blade frame assembly 66 include a central frame member 64*c*, 66*c* from which a plurality of fan blades 56*u*, 56*l*, respectively, extends in an equally spaced circumferential arrangement. When assembled the fan blades 56*u* of the upper blade frame assembly 64 are oriented relative to the fan blades 56*l* of the lower blade frame assembly 66 such that the fan blades 56*u* of the upper blade frame assembly 64 are positioned between the fan blades 56*l* of the lower blade frame assembly 66 when viewed from above or below (as shown with reference to the various figures) and when considered as the fan blades 56*u*, 56*l* extend circumferential about the respective central frame members 64*c*, 66*c*.

As with the radius of curvature, the staggered arrangement of the fan blades 56*u*, 56*l* assists in the absorption of sound waves by ensuring that the sound waves are reflected amongst the fan blades 56*u*, 56*l* and ultimately absorbed by the sound absorbing material 62. Similar, the relationship of the diameter of the fan blades 56*u*, 56*l* and the parabolic sound absorbing assembly 36 assists in optimizing the absorption of unwanted sound waves. By making the diameter of the parabolic sound absorbing assembly 36 slightly smaller than the diameter of the fan blades 56*u*, 56*l* sound waves are effectively reflected within the confines of the present fan 10 where they are ultimately absorbed before reaching the ears of a person sitting the vicinity of the fan 10.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A fan optimizing acoustic characteristics, comprising:
a yoke adapted to secure the fan to a building member;
a central support structure extending from the yoke, the central support structure is an elongated member having a first end and a second end, the first end being selectively secured to the yoke and the second end extending downwardly therefrom;
a fan assembly secured to the second end of the central support structure, the fan assembly includes a blade frame having a plurality of fan blades extending outwardly therefrom, wherein each of the fan blades includes a convex, upwardly facing surface and a concave, downwardly facing surface trapping sound within the curvature defined by the concave, downwardly facing surface so that the sound may be absorbed by a sound absorbing fabric material secured along the concave, downwardly facing surface.

2. The fan according to claim 1, wherein the central support structure is hollow and provides a passageway for electrical wires bringing power to the fan assembly.

3. The fan according to claim 1, further including a ceiling cover member covered with a sound absorbing fabric material, the ceiling cover member is shaped and dimensioned for installation adjacent a ceiling of the building member in a position opposite the yoke.

4. The fan according to claim 3, wherein the ceiling cover member is semi-spherical with a convex exterior surface and a concave interior surface.

5. The fan according to claim 3, further including a parabolic sound absorbing assembly positioned beneath the ceiling cover member and between the ceiling cover member and the fan assembly.

6. The fan according to claim 5, wherein the parabolic sound absorbing assembly includes an upper parabolic sound absorbing member and a lower parabolic sound absorbing member.

7. The fan according to claim 6, wherein the upper parabolic sound absorbing member and the lower parabolic sound absorbing member are covered with a sound absorbing fabric material.

8. The fan according to claim 6, wherein the upper parabolic sound absorbing member and the lower parabolic sound absorbing member are of a circular construction.

9. The fan according to claim 1, wherein the blade frame includes an upper blade frame assembly from which the plurality of fan blades extend and a lower blade frame assembly from which the plurality of fan blades extend.

10. The fan according to claim 9, wherein the upper blade frame assembly and the lower blade frame assembly are fixed relative to each other and rotate together.

11. The fan according to claim 10, wherein the fan blades of the upper blade frame assembly are positioned between the fan blades of the lower blade frame assembly when viewed from above or below.

* * * * *